US005822994A

United States Patent [19]

Belk et al.

[11] Patent Number: 5,822,994

[45] Date of Patent: Oct. 20, 1998

[54] LOW FRICTION LINEAR CLEARANCE SEAL

[75] Inventors: Daniel James Belk, Long Grove; Thomas S. Donahoe; Arthur R. Nelson, both of Davenport, all of Iowa; Gary W. Van Court, Rock Island, Ill.

[73] Assignee: Litton Systems, Inc., Davenport, Iowa

[21] Appl. No.: 795,972

[22] Filed: Feb. 5, 1997

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| Re. 30,176 | 12/1979 | Beale | 60/520 |
| 3,717,004 | 2/1973 | O'Neil | 62/6 |
| 3,788,088 | 1/1974 | Dehne | 62/6 |
| 4,679,994 | 7/1987 | Brown | 417/525 |
| 4,711,650 | 12/1987 | Faria et al. | 62/6 |
| 4,715,537 | 12/1987 | Calder | 239/119 |
| 4,945,993 | 8/1990 | Dickson et al. | 166/321 |
| 5,318,412 | 6/1994 | Laskaris et al. | 62/6 X |
| 5,379,939 | 1/1995 | Perret, Jr. | 239/119 |
| 5,522,214 | 6/1996 | Beckett et al. | 60/520 X |
| 5,642,623 | 7/1997 | Hiresaki et al. | 62/6 |

*Primary Examiner*—Christopher Kilner
*Attorney, Agent, or Firm*—Michael H. Wallach

[57] ABSTRACT

This invention provides a low friction linear clearance seal for use in closed cycle cryogenic coolers. The clearance seal comprises a cylinder, a piston mounted within the cylinder for reciprocating movement and a self lubricating polymer liner bonded to the piston which forms an effective seal around the piston. The clearance seal improves the sealing capability between the piston and the cylinder and reduces heat generated by the motion of the piston along the cylinder wall. The clearance seal also improves the performance and reliability of the cryogenic cooler.

19 Claims, 1 Drawing Sheet

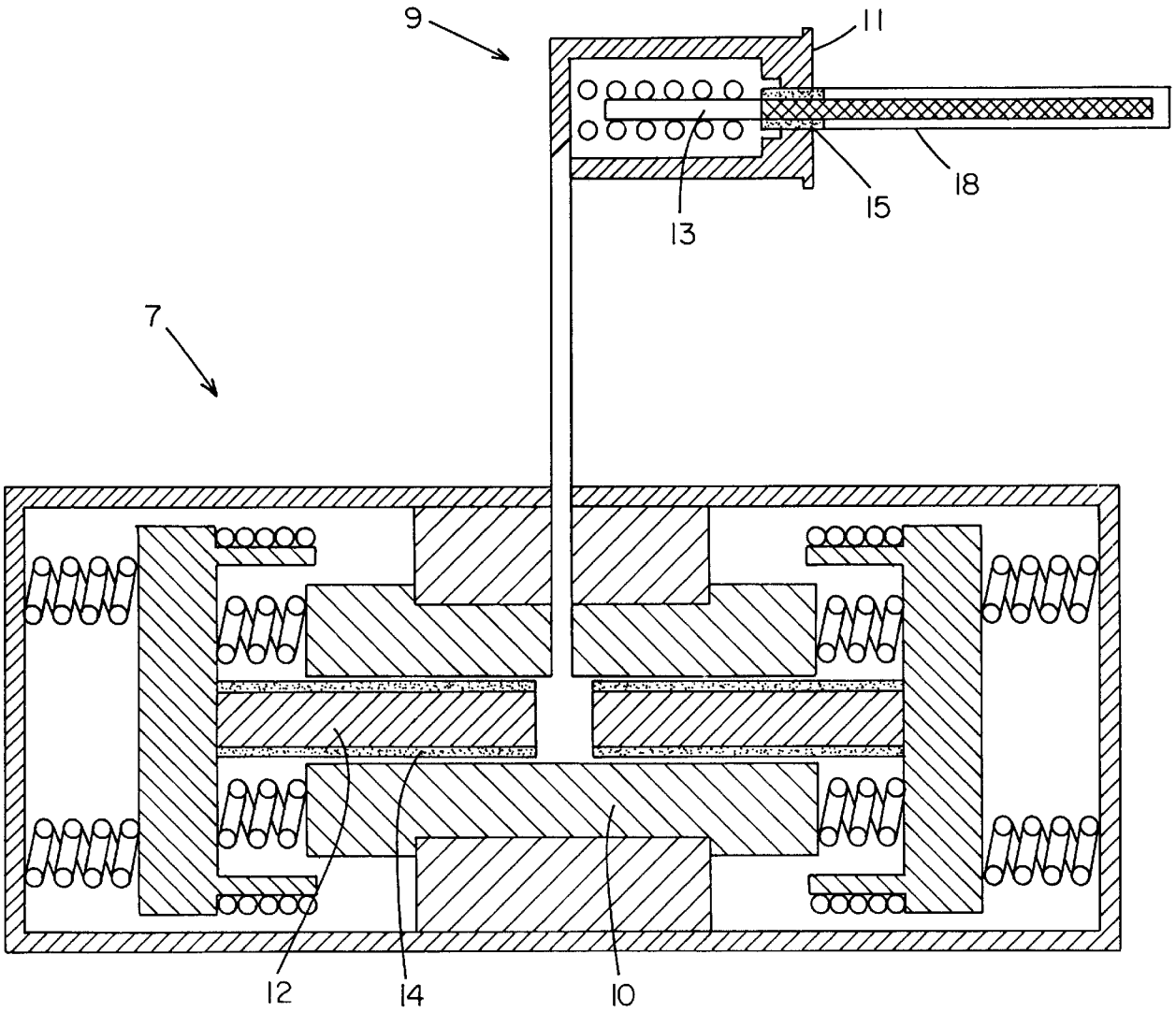
9
11
18
15
13
7
10
14
12

LOW FRICTION LINEAR CLEARANCE SEAL

FIELD OF THE INVENTION

This invention relates in general to clearance seals used in cryogenic coolers and more particularly to a low friction self lubricating linear clearance seal used in closed cycle cryogenic coolers.

BACKGROUND OF THE INVENTION

Infra-red detectors are used for night vision and heat seeking weapons. In order to operate properly, infra-red detectors must be cooled to very low temperatures approaching absolute zero. Such temperatures are referred to as cryogenic temperatures. Cryogenic coolers are used to provide a means for cooling infrared sensors so as to avoid temperature-induced "noise" and to improve the operating efficiency of the sensors. Earlier coolers operated on the Joule-Thompson principle of cryogenic refrigeration. Closed loop helium refrigerators were later developed and were based on a Stirling Cycle using a Rotary Drive Compressor which continuously produced cryogenic temperatures at a cold tip. More recently linear drive cryogenic coolers have been developed which have improved reliability, extended life, reduced vibration, and less operating noise compared to the previous types of cryogenic coolers used.

A cryogenic cooler has a compressor section and a expander section combined in a single package. The expander and compressor use reciprocating pistons which are mechanically or pneumatically driven according to a proper phase relationship so that no valves are required in the system. Helium gas is semi-hermetically sealed within a compressor volume and a working volume of the system. The compressor volume surrounds the drive motor, and space behind the compressor pistons. The working volume consists of a compression space between the compressor pistons, an interconnecting gas passage between the compressor and expander, and all other space in the expander including voids in the porous regenerator matrix, an annular clearance around a displacer, and an expansion space below the displacer. The compressor volume is isolated from the working volume by compressor piston clearance seals. Since the swept volume of the compressor pistons constitutes the major portion of the working volume, moving the pistons reciprocally in a sinusoidal manner within the cylinders generates a sinusoidally varying pressure throughout the entire working volume. The compressor volume stabilizes at a pressure level essentially equal to the average value of the fluctuating working volume pressure.

A complete cycle involves the flow of gas from the compression space through the interconnecting gas passage and the regenerator to the expansion space. The gas is then returned from the expansion space to the compression space by reversing the gas flow through the same flow-path. Refrigeration is produced in the expansion space at the tip of the cold finger. The regenerator is a porous matrix of fine wire mesh having a large heat capacity which is able to maintain a temperature gradient along its length spanning a range from about ambient to −321° F. Helium gas cools as it passes through the regenerator matrix from the compressor to the expander and warms up on the return pass.

In order for the cycle of gas flow and cooling to continue smoothly and efficiently it is important to have a clearance seal in both the compressor and expander sections of the cryogenic cooler which is both long wearing and low friction. Clearance seals typically consist of a piston with a precision machined liner bonded to it. The piston/liner assembly is matched to a precision ground cylinder with diametral gaps between the two which are controlled to very close tolerances. The liner materials currently being used are Fluorogold™, Rulon™, and ceramic. These are selected for minimal wear against the mating cylinder to provide a long life clearance seal.

The prior art liners in general, function adequately to provide a seal within the compressor and expander sections of cryogenic coolers. However, prior art clearance seals have high friction losses and therefore, cause the cryogenic cooler to be less efficient, consume more power, run hotter, and suffer from reliability problems. The high friction losses are due to the piston-liner materials used. The Fluorogold™ and Rulon™ materials, in order to wear properly, must transfer a small layer of material to the mating cylinder surface. This transfer of material may occur unevenly due to variations in surface finish, side loads on the piston, and variations in concentricity of the parts. This uneven transfer leads to a high build up of friction, causing the piston to drag or stick. The ceramic liner material does not have the transfer problems of Rulon™ or Fluorogold™. However, due to both mating surfaces being hard, the ceramic liner material cannot absorb any loose particles or debris which may enter the seal gap, and this results in scoring of the surfaces. This scoring causes high friction and eventual seizing of the piston.

Another disadvantage of using prior art liner materials is the difficulty in machining the piston liner materials. Rulon™ and Fluorogold™ will deform during machining, making it necessary to remove material slowly in thin layers to obtain the tolerances required. Likewise, ceramic liners must be ground and lapped by a slow and expensive process.

It is therefore an object of an aspect of the present invention to provide a low friction linear clearance seal for use in cryogenic coolers which overcomes the limitations of the clearance seals used in the prior art.

SUMMARY OF THE INVENTION

In accordance with a first aspect of the present invention there is provided a novel low friction linear clearance seal for use in closed cycle cryogenic coolers. The clearance seal comprises a cylinder, a piston mounted within the cylinder for reciprocating movement and a self lubricating polymer liner bonded to the piston which forms an effective seal around the piston. The new seal both improves the sealing capability between the piston and the cylinder and reduces heat generated by the motion of the piston along the cylinder wall.

The novel clearance seal significantly improves performance and reliability of the cryogenic cooler. The present invention is also less costly to produce than prior art clearance seals.

In accordance with another aspect of the present invention there is provided a low friction clearance seal using a new polymer material comprised of Ryton™ polyphenylene sulfide (PPS). The Ryton™ PPS is combined and blended with 10% carbon, 10% graphite and 10% polytetrafluoroethylene (PTFE). In another embodiment the Ryton™ PPS is blended with 15% polytetrafluoroethylene (PTFE) and 30% carbon.

In yet a further embodiment of the present invention, a dry lubricant of molybdenum disulfide is applied to both the liner and the mating surface of the cylinder. The lubricant is polished to provide additional lubricity.

BRIEF DESCRIPTION OF THE DRAWINGS

A detailed description of the preferred embodiment is provided herein below with reference to the following drawing, in which:

FIG. 1 is a side elevational view of a compressor assembly and expander assembly showing clearance seals in accordance with the preferred embodiment of the present invention.

In the drawing, a preferred embodiment of the invention is illustrated by way of example. It is to be expressly understood that the description and drawing are only for the purpose of illustration and as an aid to understanding and are not intended as a definition of the limits of the invention.

DETAILED DESCRIPTION OF THE PREFERRED EMBODIMENTS

A low friction linear clearance seal for use in cryogenic coolers according to the present invention is shown with reference to FIG. 1 in which similar reference numbers denote similar elements throughout the drawing.

A compressor section 7 of a cryogenic cooler is shown in FIG. 1 in which a low friction linear clearance seal is illustrated. The clearance seal comprises a cylinder 10 and a piston 12 which is reciprocally mounted within the cylinder 10. A liner 14 of polymer material is bonded to the outer concentric surface of the piston. The piston is typically machined from tungsten.

FIG. 1 also shows an expander section 9 of a cryogenic cooler incorporating a low friction linear clearance seal. As in the compressor, the clearance seal comprises a cylinder 11 and a piston 13 which is reciprocally mounted within the cylinder 11. In the embodiment of FIG. 1, the piston is machined from aluminum. A liner 15 of polymer material is bonded to the outer concentric surface of the piston 13. The liner 15 is machined to a diametral clearance fit of about 0.0009 inches to the coldfinger assembly 18.

In both the compressor and expander sections, the piston/liner assembly is machined to very close tolerances in order to match the precision ground cylinders 10 and 11. The diametral gap between the parts is typically about 0.0005 inches. The mating bore surface finish is held to a finish of 6 RMS (Root Mean Squared) or better. The concentricity of the mating surfaces are held to about 0.0001 inch.

The piston liners 14 and 15 are preferably made from a new polymer material known as Ryton™ polyphenylene sulfide (Ryton™ PPS) which is a semi-crystalline, high-performance polymer which has an excellent chemical resistance, chemical stability and high strength. It has a low water absorption value and a very low coefficient of linear thermal expansion providing for excellent dimensional stability during and after machining. This makes it ideal to use as a liner material. The Ryton™ PPS resin is preferably combined and blended with 10% carbon, 10% graphite, and 10% polytetrafluoroethylene (PTFE). The blended material is manufactured by the EGC Corporation of 11718 McGallion, Houston, Tex. 77076 and is referred to as EGC Alloy X-655. The Ryton™ PPS can also be blended with 15% PTFE and 30% carbon to provide a second liner material which is manufactured by LPN Corporation of 1831 East Carnegie St., Santa Ana, Calif. 92705 and is referred to as OCL-4036.

The Ryton™ PPS is a self lubricating material which does not require the transfer of material to operate as does Fluorogold™ or Rulon™ materials. The self lubricating nature of this material creates a clearance seal that is inherently lower in friction than other prior art seals. The Ryton™ PPS has a greater stiffness than other known liner materials and as such, the Ryton™ PPS machines very easily and holds its shape and dimensions, thereby reducing manufacturing costs. The Ryton™ PPS can absorb loose particles that can enter the seal area, thereby preventing scoring of the mating surfaces and extending the life of the seal. In general, the Ryton™ PPS is a self-lubricated, high moduli, flame retardant, wear, heat and chemical resistant material. The specific physical properties of the Ryton™ PPS are summarized in Table One.

In other embodiments of the present invention, a dry lubricant of molybdenum disulfide is applied to both the outer surface of the liner and the surface of the cylinder for the compressor and expander. The molybdenum disulfide is polished into the surfaces in order to provide additional lubricity.

It is understood by those skilled in the art that the low friction linear clearance seal of the present invention can be used in different types of cryogenic coolers. It is also to be understood by one skilled in the art that the low friction self-lubricating linear clearance seal of the present invention can also be used in other types of equipment which require the characteristics provided by the seal.

In summary, a novel low friction linear clearance seal is provided for use in cryogenic coolers. The low friction linear clearance seal has a self lubricating liner material which does not require the use of additional lubricants. Furthermore, the liner material is such that it prevents scoring of the mating surfaces of the piston and cylinder, thereby prolonging the life of the seal. The nature of the liner material provides for a more efficient cryogenic cooler system. The clearance seal is easy and cost efficient to machine and manufacture.

While embodiments of the present invention have been illustrated and described, it will be evident to those skilled in the art that variations and modifications may be made therein without departing from the scope of the invention as defined by the claims appended hereto.

TABLE One

| | |
|---|---|
| Filler/Reinforcement | Carbon Fiber |
| Flexural Strength | 36.00k |
| Percentage of Filler | 30% |
| Flexural Modulus | 3.00 M |
| Processing Method | Injection |
| Compressive Str. (PSI) | 19.00k |
| Ratings | UL |
| Izod RT (ftib/in) | 1.0 |
| Processing Temperature | 610° F. |
| Hardness (Test) | R123 (Rockwell) |
| Mold Pressure (PSI) | 17.50k |
| Therm. Cond. BTU in/hr ft2 × F | 2.50 |
| Mold Shrinkage (in/in) | 1.00 m |
| Thermal Exp. (In/in × F) | 9.00 u |
| Density (lb/ft3) | 96.1 |
| HDT @ 264 PSI (×F) D648 | 500 |
| Tensile @ Break (PSI) | 25.00k |
| HDT @ 66 PSI (×F) D648 | 500 |
| Elongation @ Break (%) | 0 |
| Volume Res. (Ohm-cm) D257 | 40.0 |
| Tensile Modulus (PSI) | 3.80 M |
| Water Absorption (%) D570 | 0.020 |
| UL Standard 94 | V-O |
| Injection Mfg | Yes |

What is claimed is:

1. A clearance seal for use in cryogenic coolers, the cryogenic cooler comprising a compressor having at least one piston at least partially mounted within a cylinder, said clearance seal comprising:

a self lubricating liner concentrically bonded to the piston, the piston having a longitudinal length and said liner extending substantially the longitudinal length of the piston.

2. A low friction linear clearance seal as claimed in claim 1, wherein said liner is made of a polymer material.

3. A low friction linear clearance seal as claimed in claim 2, wherein said polymer comprises polyphenylene sulfide.

4. A low friction linear clearance seal as claimed in claim 3, wherein said polyphenylene sulfide is combined with 10% carbon, 10% graphite and 10% polytetrafluoroethylene.

5. A low friction linear clearance seal as claimed in claim 3, wherein said polyphenylene sulfide is combined with 15% polytetrafluoroethylene and 30% carbon.

6. A low friction linear clearance seal as claimed in claim 1, further comprising a dry lubricant applied to said liner and the cylinder for additional lubricity.

7. A low friction linear clearance seal as claimed in claim 6, wherein said dry lubricant is molybdenum disulfide.

8. A low friction linear clearance seal is claimed in claim 1, wherein a diametral gap exists between the liner and the cylinder, said gap being about 0.0005 inches.

9. A low friction linear clearance seal as claimed in claim 1, wherein the cylinder and the liner have concentric surfaces, the concentric surface of said cylinder being held at 0.0001 inches of the concentric surface of said liner.

10. A clearance seal for use in cryogenic coolers comprising an expander having a regenerator at least partially mounted within a cylinder, said clearance comprising:

a self lubricating liner concentrically bonded to the piston, the piston having a longitudinal length and said liner extending substantially the longitudinal length of the piston.

11. The seal of claim 11, wherein said self lubricating liner comprises polyphenylene sulfide.

12. The seal as claimed in claim 11, wherein said polyphenylene sulfide is combined with 10% carbon, 10% graphite and 10% polytetrafluoroethylene.

13. The seal as claimed in claim 12, wherein said polyphenylene sulfide is combined with 15% polytetrafluoroethylene and 30% carbon.

14. The seal as claimed in claim 11, further comprising a dry lubricant applied to said liner and the cylinder for additional lubricity.

15. The seal as claimed in claim 14, wherein said dry lubricant is molybdenum disulfide.

16. The seal is claimed in claim 10, wherein a diametral gap exists between the liner and the cylinder, said gap being about 0.0005 inches.

17. The seal as claimed in claim 10, wherein the cylinder and the liner have concentric surfaces, the concentric surface of said cylinder being held at 0.0001 inches of the concentric surface of said liner.

18. The seal of claim 10, wherein the liner is a semi-crystalline polymer.

19. The clearance seal of claim 1, wherein the liner is a semi-crystalline polymer.

* * * * *